US008714551B1

(12) United States Patent
Santana

(10) Patent No.: US 8,714,551 B1
(45) Date of Patent: May 6, 2014

(54) RAFFLE GAMING SYSTEM

(76) Inventor: Rafael Angel Santana, Sunset, FL (US)

( * ) Notice: Subject to any disclaimer, the term of this patent is extended or adjusted under 35 U.S.C. 154(b) by 29 days.

(21) Appl. No.: 13/568,177

(22) Filed: Aug. 7, 2012

(51) Int. Cl.
*A63B 71/00* (2006.01)

(52) U.S. Cl.
USPC ..... 273/139

(58) Field of Classification Search
USPC ..... 273/139
See application file for complete search history.

(56) References Cited

U.S. PATENT DOCUMENTS

| | | | | |
|---|---|---|---|---|
| 7,018,292 | B2 * | 3/2006 | Tracy et al. | 463/17 |
| 7,213,811 | B2 * | 5/2007 | Bozeman | 273/139 |
| 8,337,309 | B2 * | 12/2012 | Okuniewicz | 463/41 |
| 8,353,757 | B2 * | 1/2013 | Walker et al. | 463/25 |
| 8,353,763 | B2 * | 1/2013 | Amaitis et al. | 463/28 |
| 8,452,687 | B2 * | 5/2013 | Rowe | 705/37 |
| 8,512,123 | B2 * | 8/2013 | Stanek et al. | 463/17 |
| 8,523,684 | B2 * | 9/2013 | Lutnick et al. | 463/47 |

OTHER PUBLICATIONS

NASPL—Contributions & Beneficiaries—2011.*

* cited by examiner

*Primary Examiner* — Kurt Fernstrom
*Assistant Examiner* — Dolores Collins
(74) *Attorney, Agent, or Firm* — Albert Bordas, P.A.

(57) ABSTRACT

A raffle gaming system having the steps of establishing a desired monetary goal; assigning a monetary value to each of a plurality of raffle tickets; selling the plurality of raffle tickets to at least meet the desired monetary goal; collecting payments from sale of the plurality of raffle tickets; selecting a first raffle ticket of the plurality of raffle tickets sold as a first winner; allocating a first percentage from the payments collected from the sale of the plurality of raffle tickets to an organizer; allocating a second percentage from the payments collected from the sale of the plurality of raffle tickets to the first winner as a first cash prize; and allocating a third percentage from the payments collected from the sale of the plurality of raffle tickets to the first winner as a conditioned prize for unemployment insurance, business development, and/or real estate investment.

10 Claims, 3 Drawing Sheets

RAFFLE GAMING SYSTEM

BACKGROUND OF THE INVENTION

1. Field of the Invention

The present invention relates to gaming systems, and more particularly, to raffle gaming systems.

2. Description of the Related Art

Several raffle and lottery games have been designed in the past. However, they do not disclose or suggest the novel features of the present invention.

SUMMARY OF THE INVENTION

The instant invention is a raffle gaming system, comprising the steps of:

A) establishing a desired monetary goal;

B) assigning a monetary value to each of a plurality of raffle tickets;

C) selling the plurality of raffle tickets to at least meet the desired monetary goal;

D) collecting payments from sale of the plurality of raffle tickets;

E) selecting a first raffle ticket of the plurality of raffle tickets sold as a first winner;

F) allocating a first percentage from the payments collected from the sale of the plurality of raffle tickets to an organizer;

G) allocating a second percentage from the payments collected from the sale of the plurality of raffle tickets to the first winner as a first cash prize; and H) allocating a third percentage from the payments collected from the sale of the plurality of raffle tickets to the first winner as a conditioned prize for unemployment insurance, business development, and/or real estate investment.

The raffle gaming system further comprises the steps of:

I) allocating a fourth percentage from the third percentage for the unemployment insurance. The fourth percentage for the unemployment insurance covers a first predetermined number of employees for a first predetermined time period for a new or existing business.

The raffle gaming system further comprises the steps of:

J) allocating a fifth percentage from the third percentage for the business development. The fifth percentage for the business development covers business expenses for a new or existing business having at least a first predetermined number of employees. As an alternative, the fifth percentage for the business development is divided into at least a sixth and seventh percentage. The sixth percentage is allocated to the first winner as a second cash prize and the seventh percentage is allocated to a business fund.

The raffle gaming system further comprises the steps of:

K) allocating a sixth percentage from the third percentage for the real estate investment. Assuming that the fifth percentage for the business development covers business expenses for a new or existing business having at least a first predetermined number of employees defined above. The sixth percentage for the real estate investment is allocated towards new or existing real estate. As an alternative, the sixth percentage for the real estate investment is divided into at least a seventh and eighth percentage. The seventh percentage is allocated to the first winner as a second, or possible third, cash prize, and the eighth percentage is allocated to a real estate fund.

The raffle gaming system further comprises the steps of:

L) selling the plurality of raffle tickets to exceed the desired monetary goal;

M) collecting payments from sale of the plurality of raffle tickets exceeding the desired monetary goal;

N) selecting at least a second raffle ticket of the plurality of raffle tickets sold from the plurality of raffle tickets exceeding the desired monetary goal as at least a second winner; and O) allocating another percentage from the payments collected from sale of the plurality of raffle tickets exceeding the desired monetary goal to the at least a second winner.

It is therefore one of the main objects of the present invention to provide a raffle gaming system designed to motivate a winner to participate in unemployment insurance for business development.

It is another object of this invention to provide a raffle gaming system designed to motivate a winner to participate in business development.

It is another object of this invention to provide a raffle gaming system designed to motivate a winner to participate in real estate investment.

It is another object of this invention to provide a raffle gaming system designed to stimulate an economy.

It is another object of this invention to provide a raffle gaming system that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
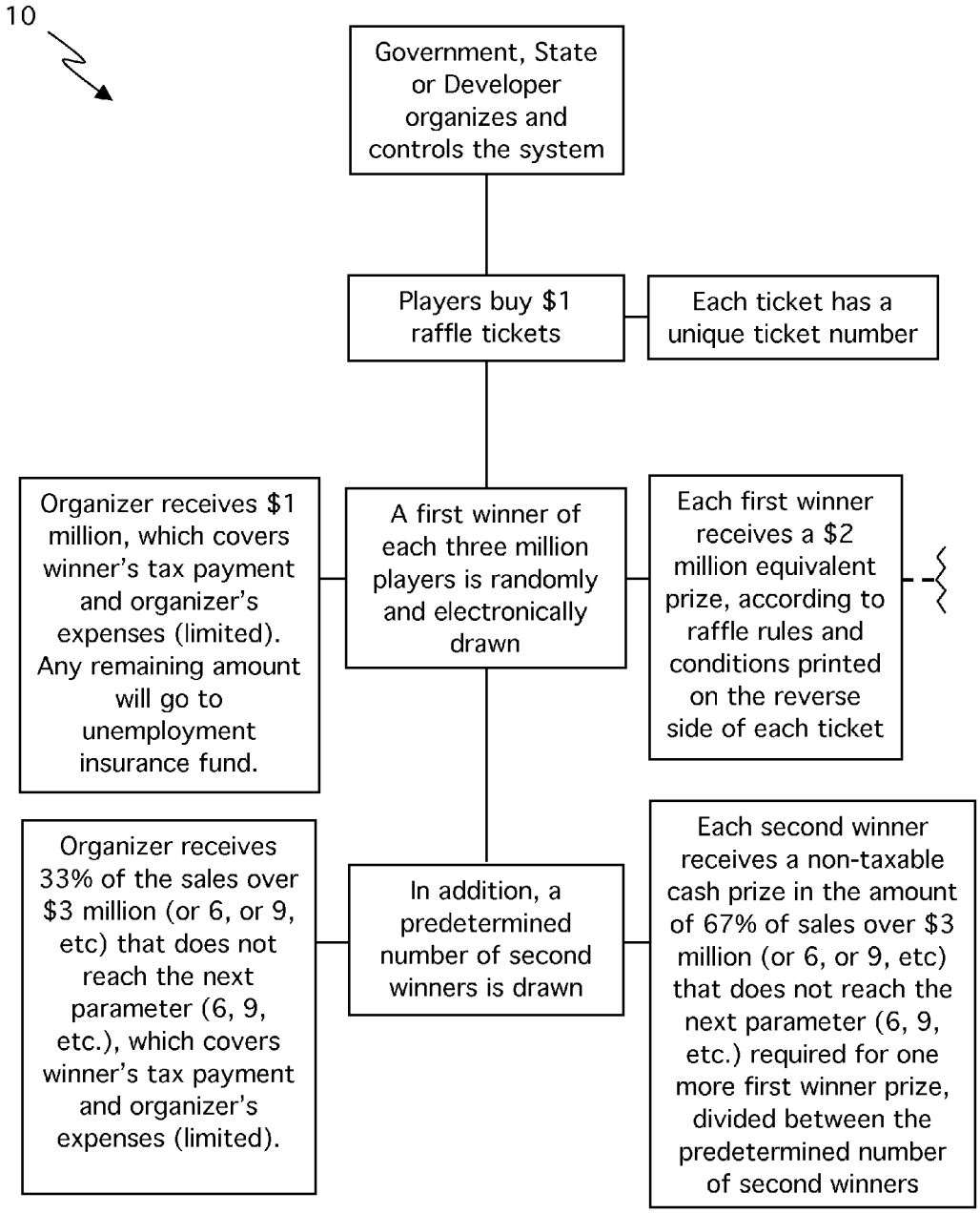
FIG. 1 represents a first flowchart of the raffle gaming system, object of the present invention.

Referring now to the drawings, the present invention is a raffle gaming system and is generally referred to with numeral 10. Raffle gaming system 10 is a number-match game with a limited number of raffle tickets available that are sold within a limited sales period. The instant invention is a raffle gaming system, comprising the steps of:

A) establishing a desired monetary goal;

B) assigning a monetary value to each of a plurality of raffle tickets;

C) selling the plurality of raffle tickets to at least meet the desired monetary goal;

D) collecting payments from sale of the plurality of raffle tickets;

E) selecting a first raffle ticket of the plurality of raffle tickets sold as a first winner;

F) allocating a first percentage from the payments collected from the sale of the plurality of raffle tickets to an organizer;

G) allocating a second percentage from the payments collected from the sale of the plurality of raffle tickets to the first winner as a first cash prize; and H) allocating a third percentage from the payments collected from the sale of the plurality of raffle tickets to the first winner as a conditioned prize for unemployment insurance, business development, and/or real estate investment.

Figure 2:
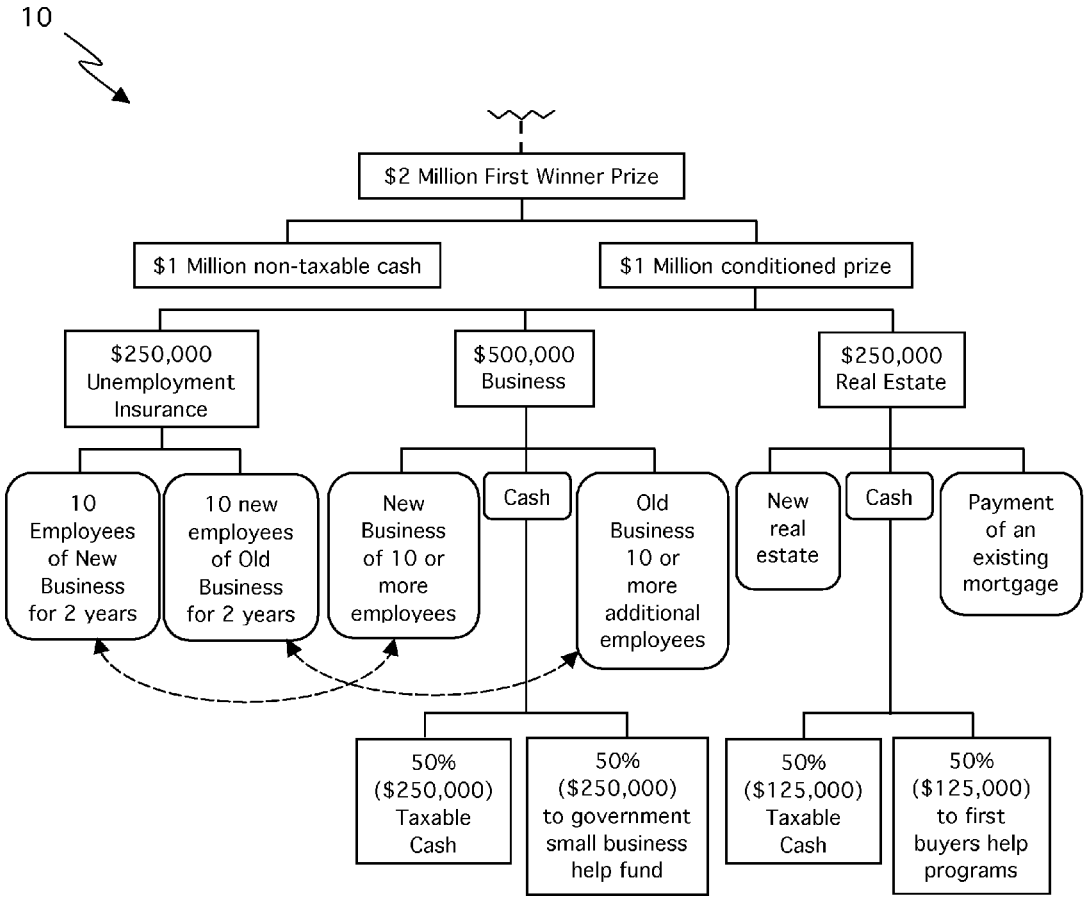
FIG. 2 represents a second flowchart of the raffle gaming system, detailing prize distributions and alternatives.

Seen in FIGS. 1 and 2, is an example of one embodiment of the instant invention 10.

Regarding step A) establishing a desired monetary goal, the illustrated embodiment defines the desired monetary goal to be $3,000,000.

Regarding step B) assigning a monetary value to each of a plurality of raffle tickets, each raffle ticket can cost $1.

Regarding step C) selling the plurality of raffle tickets to at least meet the desired monetary goal, raffle tickets are sold by an organizer to at least make the desired monetary goal of $3,000,000. The organizer can be a public or private entity licensed to operate a gaming system such as instant invention 10. As an example, the organizer can be the Florida Lottery. The organizer may also be a government agency or licensed independent developer. The plurality of raffle tickets go on sale on a particular date as determined by the organizer. Sales of the plurality of raffle tickets will continue after the 3,000,000$^{th}$ raffle ticket is sold.

In a preferred embodiment, the raffle tickets will automatically print from a terminal with ticket numbers issued in sequential order from 0000001 to 3,000,000 as they are sold. Each raffle ticket will contain only one raffle ticket number. Players cannot select their own ticket numbers, and cannot be cancelled. Game rules and conditions may be printed on each raffle ticket.

Regarding step D) collecting payments from sale of the plurality of raffle tickets, payments are collected at each retailer or collection center that offers the plurality of raffle tickets for sale. Regarding step E) selecting a first raffle ticket of the plurality of raffle tickets sold as a first winner, may occur upon the first 3,000,000$^{th}$ raffle ticket sold. Each raffle ticket will contain a unique ticket number that will be automatically entered in the instant invention 10 drawing. The overall odds of winning a prize in the instant invention 10 drawing vary according to the number of raffle tickets sold.

A random computerized drawing from among all plurality of raffle ticket numbers issued during the sales period is performed. At least one prize is awarded. Prizes will be awarded in the order drawn.

Regarding step F) allocating a first percentage from the payments collected from the sale of the plurality of raffle tickets to an organizer, in the example of one embodiment of the instant invention 10, the organizer is allocated approximately 33.33% of the $3,000,000, equating to approximately $1,000,000. This sum covers all federal, state and/or local taxes otherwise due by the first winner for the first cash prize, and operating expenses. Any remaining funds may go towards the unemployment insurance, which may be a fund.

Figure 3:
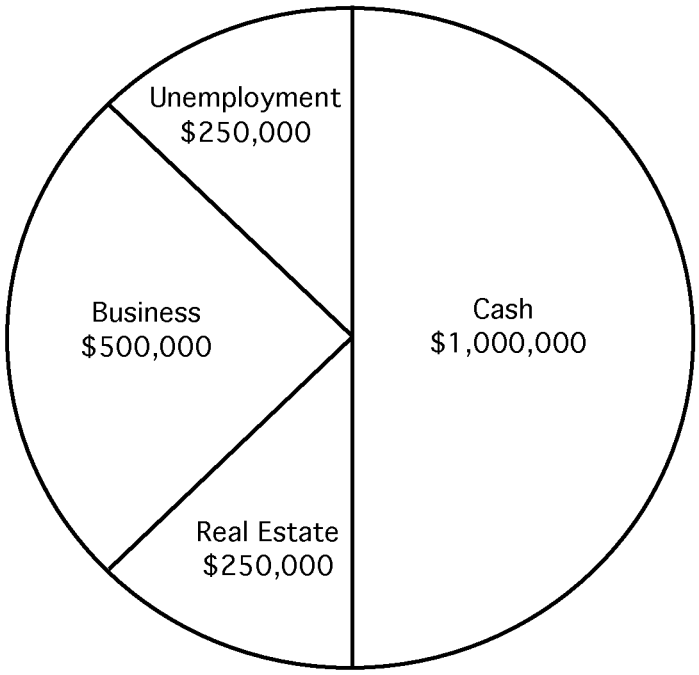
FIG. 3 represents a raffle gaming system monetary distribution pie chart.

As seen in FIG. 3, regarding step G) allocating a second percentage from the payments collected from the sale of the plurality of raffle tickets to the first winner as a first cash prize, in the example of one embodiment of the instant invention 10, the first winner is allocated approximately 33.33% of the $3,000,000, equating to approximately $1,000,000 as the first cash prize. The organizer is responsible for any and all taxes.

As seen in FIG. 3, regarding step H) allocating a third percentage from the payments collected from the sale of the plurality of raffle tickets to the first winner as a conditioned prize for unemployment insurance, business development, and/or real estate investment, whereby in the example of one embodiment of the instant invention 10 the first winner is additionally allocated approximately 33.33% of the $3,000,000, equating to approximately $1,000,000 as the conditioned prize.

The raffle gaming system further comprises the steps of:

I) allocating a fourth percentage from the third percentage for the unemployment insurance. The fourth percentage for the unemployment insurance covers a first predetermined number of employees for a first predetermined time period for a new or existing business.

Regarding step I) allocating a fourth percentage from the third percentage for the unemployment insurance, the fourth percentage for the unemployment insurance covers a first predetermined number of employees for a first predetermined time period for a new or existing business. In the example of one embodiment of the instant invention 10, the fourth percentage can be approximately 25% of the $1,000,000, equating to approximately $250,000. The first predetermined number of employees can be a minimum of 10, and the first predetermined time period can be a minimum of 2 years, whereby unemployment benefits are paid to the first predetermined number of employees in the event the new or existing business files for and/or becomes bankrupt.

The raffle gaming system further comprises the steps of:

J) allocating a fifth percentage from the third percentage for the business development. The fifth percentage for the business development covers business expenses for a new or existing business having at least a first predetermined number of employees. In a preferred embodiment, the business is located within the country operating instant invention 10. Specifically, the creation of business should not be overseas. Additionally, the business cannot be sold or transferred to another person and/or entity during a second predetermined period of time. In the preferred embodiment, the second predetermined period of time is two years. As an alternative, the fifth percentage for the business development is divided into at least a sixth and seventh percentage. The sixth percentage is allocated to the first winner as a second cash prize and the seventh percentage is allocated to a business fund.

Regarding step J) allocating a fifth percentage from the third percentage for the business development. The fifth percentage for the business development covers business expenses for a new or existing business having at least a first predetermined number of employees, in the example of one embodiment of the instant invention 10, the fifth percentage can be approximately 50% of the $1,000,000, equating to approximately $500,000. The first predetermined number of employees for the new or existing business can be a minimum of 10.

As an alternative, the fifth percentage for the business development is divided into at least a sixth and seventh percentage. The sixth percentage is allocated to the first winner as a second cash prize, taxable, and the seventh percentage is allocated to a business fund. The sixth and seventh percentages can each be approximately 25% of the $1,000,000, equating to approximately $250,000.

The raffle gaming system further comprises the steps of:

K) allocating a sixth percentage from the third percentage for the real estate investment. Assuming that the fifth percentage for the business development covers business expenses for a new or existing business having at least a first predetermined number of employees defined above. The sixth percentage for the real estate investment is allocated towards new or existing real estate. As an alternative, the sixth percentage for the real estate investment is divided into at least a seventh and eighth percentage. The seventh percentage is allocated to the first winner as a second, or possible third, cash prize, and the eighth percentage is allocated to a real estate fund.

Regarding step K) allocating a sixth percentage from the third percentage for the real estate investment. Assuming that the fifth percentage for the business development covers business expenses for a new or existing business having at least a first predetermined number of employees defined above. The sixth percentage for the real estate investment is allocated towards new or existing real estate, in the example of one embodiment of the instant invention 10, the sixth percentage can be approximately 25% of the $1,000,000, equating to approximately $250,000 to purchase a real estate and/or payment of an existing mortgage. In a preferred embodiment, the real estate investment is within the country operating instant invention 10. Specifically, not be overseas.

As an alternative, the sixth percentage for the real estate investment is divided into at least a seventh and eighth percentage. The seventh percentage is allocated to the first winner as a second, or possible third, cash prize, taxable, and the eighth percentage is allocated to a real estate fund for first-time buyers. The seventh and eighth percentages can each be approximately 12.5% of the $1,000,000, equating to approximately $125,000.

The raffle gaming system further comprises the steps of:

L) selling the plurality of raffle tickets to exceed the desired monetary goal;

M) collecting payments from sale of the plurality of raffle tickets exceeding the desired monetary goal;

N) selecting at least a second raffle ticket of the plurality of raffle tickets sold from the plurality of raffle tickets exceeding the desired monetary goal as at least a second winner; and O) allocating another percentage from the payments collected from sale of the plurality of raffle tickets exceeding the desired monetary goal to the at least a second winner.

Regarding step L) selling the plurality of raffle tickets to exceed the desired monetary goal, the illustrated embodiment defines the desired monetary goal to exceed as $3,000,000.

Regarding step M) collecting payments from sale of the plurality of raffle tickets exceeding the desired monetary goal, payments are collected at each retailer or collection center that offers the plurality of raffle tickets for sale.

Regarding step N) selecting at least a second raffle ticket of the plurality of raffle tickets sold from the plurality of raffle tickets exceeding the desired monetary goal as at least a second winner, may occur after the first $3{,}000{,}000^{th}$ raffle ticket sold. Each raffle ticket will contain a unique ticket number that will be automatically entered in the instant invention 10 drawing. The overall odds of winning a prize in the instant invention 10 drawing vary according to the number of raffle tickets sold.

A random computerized drawing from among all plurality of raffle ticket numbers issued during the sales period is performed. Prizes will be awarded in the order drawn.

Regarding step O) allocating another percentage from the payments collected from sale of the plurality of raffle tickets exceeding the desired monetary goal to the at least a second winner, in the example of one embodiment of the instant invention 10, the second winner is allocated a percentage of the payments collected from sale of the plurality of raffle tickets exceeding the desired monetary goal. The organizer covers all federal, state and/or local taxes otherwise due by the at least a second winner for the second cash prize, and operating expenses.

Instant invention 10 may have additional rules. Such additional rules, as an example may include the following: The instant invention 10 drawing will be held, and shall be public and witnessed by an accountant employed by an independent certified public accounting firm. Winning numbers will be available after the drawing on a web site, or at a retailer. Winning raffle tickets can be claimed at the organizer for payment. The raffle tickets are the only valid receipts to redeem a prize. The raffle ticket prizes must be claimed within 180 days from the date of the drawing. Players must be at least 18 years of age. Persons prohibited by law from purchasing a raffle ticket are not eligible to play.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A raffle gaming system, comprising the steps of:

A) establishing a desired monetary goal;

B) assigning a monetary value to each of a plurality of raffle tickets;

C) selling said plurality of raffle tickets to at least meet said desired monetary goal, said plurality of raffle tickets automatically print from a terminal;

D) collecting payments from sale of said plurality of raffle tickets;

E) selecting a first raffle ticket of said plurality of raffle tickets sold as a first winner, said selecting a first raffle ticket performed by a first random computerized drawing utilizing a computer, said computer being a device with a microprocessor configured to store a file on a non-transitory computer readable medium, said computer comprises computer software having a first algorithm to perform said first random computerized drawing;

F) allocating a first percentage from said payments collected from said sale of said plurality of raffle tickets to an organizer;

G) allocating a second percentage from said payments collected from said sale of said plurality of raffle tickets to said first winner as a first cash prize;

H) allocating a third percentage from said payments collected from said sale of said plurality of raffle tickets to said first winner as a conditioned prize for unemployment insurance, business development, and real estate investment.

2. The raffle gaming system set forth in claim 1, further comprising the steps of:

I) allocating a fourth percentage from said third percentage for said unemployment insurance, said fourth percentage for said unemployment insurance covers a first predetermined number of employees for a first predetermined time period for a new or existing business.

3. The raffle gaming system set forth in claim 2, further comprising the steps of:

J) allocating a fifth percentage from said third percentage for said business development, fifth percentage for said business development covers business expenses for a new or existing business having at least a first predetermined number of employees.

4. The raffle gaming system set forth in claim 3, further characterized in that said fifth percentage for said business development is divided into at least a sixth and seventh percentage, said sixth percentage is allocated to said first winner as a second cash prize.

5. The raffle gaming system set forth in claim 4, further characterized in that said seventh percentage is allocated to a business fund.

6. The raffle gaming system set forth in claim 3, further comprising the steps of:

K) allocating a sixth percentage from said third percentage for said real estate investment.

7. The raffle gaming system set forth in claim 6, further characterized in that said sixth percentage for said real estate investment is allocated towards new or existing real estate.

8. The raffle gaming system set forth in claim 6, further characterized in that said sixth percentage for said real estate investment is divided into at least a seventh and eighth percentage, said seventh percentage is allocated to said first winner as a second cash prize.

9. The raffle gaming system set forth in claim 8, further characterized in that said eighth percentage is allocated to a real estate fund.

10. The raffle gaming system set forth in claim 1, further comprising the steps of:

I) selling said plurality of raffle tickets to exceed said desired monetary goal;

J) collecting payments from sale of said plurality of raffle tickets exceeding said desired monetary goal;

K) selecting at least a second raffle ticket of said plurality of raffle tickets sold from said plurality of raffle tickets exceeding said desired monetary goal as at least a second winner, said selecting a second raffle ticket performed by a second random computerized drawing utilizing said computer, said computer comprises said computer software having a second algorithm to perform said second random computerized drawing; and L) allocating a fourth percentage from said payments collected from sale of said plurality of raffle tickets exceeding said desired monetary goal to said at least a second winner.

* * * * *